US006767150B1

(12) United States Patent
Sheu

(10) Patent No.: US 6,767,150 B1
(45) Date of Patent: Jul. 27, 2004

(54) AUTOMATIC PENCIL ASSEMBLY

(76) Inventor: Rong-Lin Sheu, 58, Ma Yuan West St., Taichung (TW)

( * ) Notice: Subject to any disclaimer, the term of this patent is extended or adjusted under 35 U.S.C. 154(b) by 0 days.

(21) Appl. No.: 10/743,682

(22) Filed: Dec. 19, 2003

(51) Int. Cl.[7] ..... B43K 21/22
(52) U.S. Cl. ..... 401/93; 401/89; 401/92; 401/94; 401/86
(58) Field of Search ..... 401/53, 65, 67, 401/86, 88, 89, 92–94

(56) References Cited

U.S. PATENT DOCUMENTS 3,947,133 A * 3/1976 Kageyama et al. ..... 401/94
4,538,934 A * 9/1985 Brunner ..... 401/94
6,254,296 B1 * 7/2001 Sheu ..... 401/92

* cited by examiner

*Primary Examiner*—Tuan N. Nguyen

(57) ABSTRACT

An automatic pencil assembly includes a barrel, a point, an urging member, two clamping members, a slide, a guide pipe, a lead, a cap, and a push member. Thus, the lead is pressed downward by the first plug or second plug of the push member to overcome the holding force of the clamping members, so that the lead is inserted into and protruded outward from the slide easily and conveniently.

17 Claims, 13 Drawing Sheets

AUTOMATIC PENCIL ASSEMBLY

BACKGROUND OF THE INVENTION

1. Field of the Invention

The present invention relates to an automatic pencil assembly, and more particularly to an automatic pencil assembly, wherein the lead is pressed downward to overcome the holding force of the clamping members, so that the lead is inserted into and protruded outward from the slide easily and conveniently.

2. Description of the Related Art

A conventional automatic pencil in accordance with the prior art shown in FIG. 16 comprises a barrel 100, a point 200 mounted on a first end of the barrel 100 and having a first end formed with a sleeve 201 inserted into the first end of the barrel 100, an urging member 203 secured in the sleeve 201 of the point 200 and having an inner wall formed with a tapered face 207, two clamping members 202 each slidably mounted in the urging member 203 and having an outer wall formed with a cavity 204 for receiving a plurality of balls 205 which are urged on the tapered face 207 of the urging member 203 to contract the two clamping members 202 inward, a slide 300 slidably mounted in the point 200 and having a first end provided with a retaining race 400 and a second end protruded outward from a second end of the point 200, a spring 206 mounted in the first end of the slide 300 and urged between the slide 300 and the clamping members 202, a guide pipe 600 mounted in the barrel and rested on an end of the urging member 203, a lead 500 in turn extended through the guide pipe 600, the clamping members 202, the retaining race 400 and the slide 300 and protruded outward from the slide 300, and a cap 700 mounted on a second end of the barrel 100 and provided with an eraser 701.

In operation, the cap 700 is removed from the barrel 100, so that the lead 500 is placed into the barrel 100. Then, the lead 500 is in turn extended through the guide pipe 600, the clamping members 202, the retaining race 400 and the slide 300 and protruded outward from the slide 300. Thus, when the lead 500 is rested on a paper (not shown), the paper applies a reaction force on the slide 300 to draw the lead 500 outward from the slide 300 automatically.

However, the user needs to slightly shake the barrel 100 to facilitate the lead 500 sliding into the slide 300, thereby causing inconvenience to the user. In addition, when the lead 500 has a greater length, the lead 500 is slightly bent due to its greater length, so that the lead 500 cannot pass through the slide 300 smoothly and is easily jammed or broken. Further, the barrel 100 cannot carry spare leads, thereby causing inconvenience to the user.

SUMMARY OF THE INVENTION

The primary objective of the present invention is to provide an automatic pencil assembly, wherein the lead is pressed downward by the first plug or second plug of the push member to overcome the holding force of the clamping members, so that the lead is inserted into and protruded outward from the slide easily and conveniently.

Another objective of the present invention is to provide an automatic pencil assembly, wherein the extension of the cap is used to store a plurality of spare leads, thereby facilitating the user carrying the leads.

A further objective of the present invention is to provide an automatic pencil assembly, wherein the rectangular guide hole of the guide pipe only allows passage of one lead, thereby preventing the leads from jamming.

A further objective of the present invention is to provide an automatic pencil assembly, wherein the guide pipe is formed be combining two semi-circular tubular together, so that the guide pipe is made easily and rapidly, thereby decreasing costs of fabrication.

A further objective of the present invention is to provide an automatic pencil assembly, wherein the rectangular guide hole of the guide pipe facilitates passage of the lead, so that the lead is moved in the rectangular guide hole of the guide pipe smoothly and conveniently.

A further objective of the present invention is to provide an automatic pencil assembly, wherein the first end of the barrel is formed with an inner thread, and the sleeve of the point is formed with an outer thread screwed into the inner thread of the barrel, so that the point is combined with the barrel easily and conveniently.

In accordance with the present invention, there is provided an automatic pencil assembly, comprising:

a barrel, a point, an urging member, two clamping members, a slide, a guide pipe, a lead, a cap, and a push member, wherein:

the barrel has a first end and a second end;

the point is mounted on the first end of the barrel and has a first end formed with a sleeve inserted into the first end of the barrel;

the urging member is mounted in the first end of the barrel and is secured in the sleeve of the point;

each of the two clamping members is slidably mounted in the urging member;

the slide is slidably mounted in the point and has a first end provided with a retaining race and a second end protruded outward from a second end of the point;

the guide pipe is mounted in the barrel and is rested on an end of the urging member;

the lead is in turn extended through the guide pipe, the clamping members, the retaining race and the slide and has a first end protruded outward from the guide pipe and a second end protruded outward from the slide;

the cap is mounted on the second end of the barrel and has an end formed with a cylindrical extension extended into the barrel; and the push member is mounted on an end of the extension of the cap to seal the extension of the cap and is rested on the first end of the lead, the push member has a first end formed with a first plug that is insertable into the extension of the cap and a second end formed with a second plug that is insertable into the extension of the cap.

Further benefits and advantages of the present invention will become apparent after a careful reading of the detailed description with appropriate reference to the accompanying drawings.

DETAILED DESCRIPTION OF THE INVENTION

Figure 1:
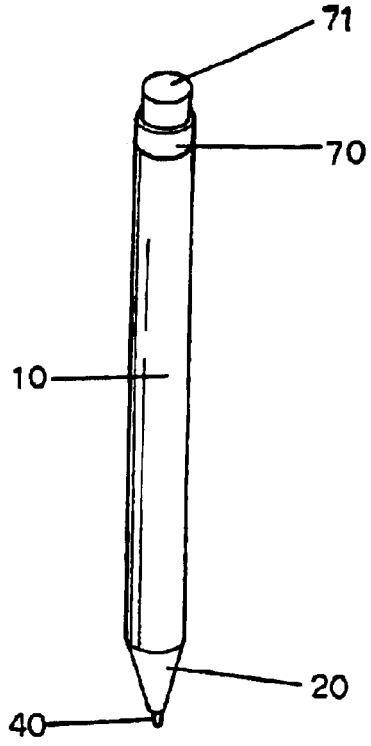
FIG. 1 is a perspective view of an automatic pencil assembly in accordance with the preferred embodiment of the present invention.
Figure 2:
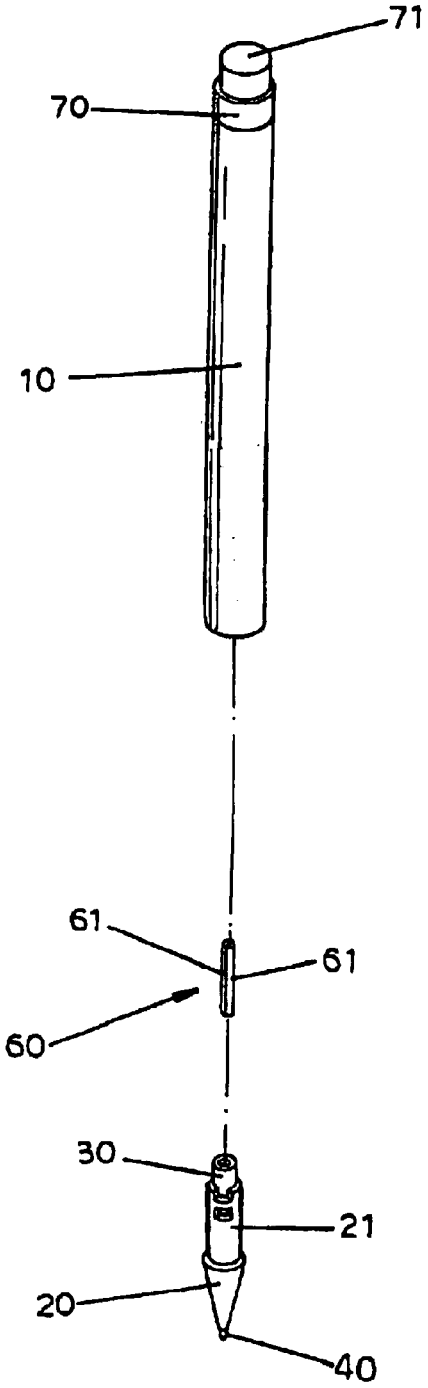
FIG. 2 is a partially exploded perspective view of the automatic pencil assembly as shown in FIG. 1.
Figure 3:
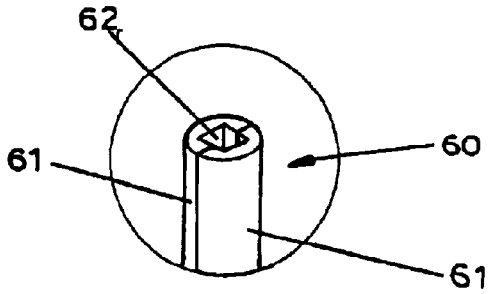
FIG. 3 is a partially enlarged view of a guide pipe of the automatic pencil assembly as shown in FIG. 2.

Referring to the drawings and initially to FIGS. 1–4, an automatic pencil assembly in accordance with the preferred embodiment of the present invention comprises a barrel 10, a point 20, an urging member 30, two clamping members 41, a slide 40, a guide pipe 60, a lead 50, a cap 70, and a push member 73.

The barrel 10 has a first end and a second end.

The point 20 is mounted on the first end of the barrel 10 and has a first end formed with a sleeve 21 inserted into the first end of the barrel 10.

The urging member 30 is mounted in the first end of the barrel 10 and is secured in the sleeve 21 of the point 20. The urging member 30 has an inner wall formed with a tapered face 31.

Each of the two clamping members 41 is slidably mounted in the urging member 30 and has an outer wall formed with a cavity 43 for receiving a plurality of balls 43 which are urged on the tapered face 31 of the urging member 30 to contract the two clamping members 41 inward.

The slide 40 is slidably mounted in the point 20 and has a first end provided with a retaining race 45 and a second end protruded outward from a second end of the point 20. A spring 42 is mounted in the first end of the slide 40 and is urged between the slide 40 and the clamping members 41.

The guide pipe 60 is mounted in the barrel 10 and is rested on an end of the urging member 30. The guide pipe 60 has an inside formed with a rectangular guide hole 62 communicating with the two clamping members 41 and having an end formed with an arcuate guide portion 63. Preferably, the guide pipe 60 consists of two semi-circular tubular 61 combined with each other.

The lead 50 is in turn extended through the guide hole 62 of the guide pipe 60, the clamping members 41, the retaining race 45 and the slide 40 and is protruded outward from the slide 40.

The cap 70 is mounted on the second end of the barrel 10 and is provided with an eraser 71. The cap 70 has an end formed with a cylindrical extension 72 extended into the barrel 10.

Figure 4:
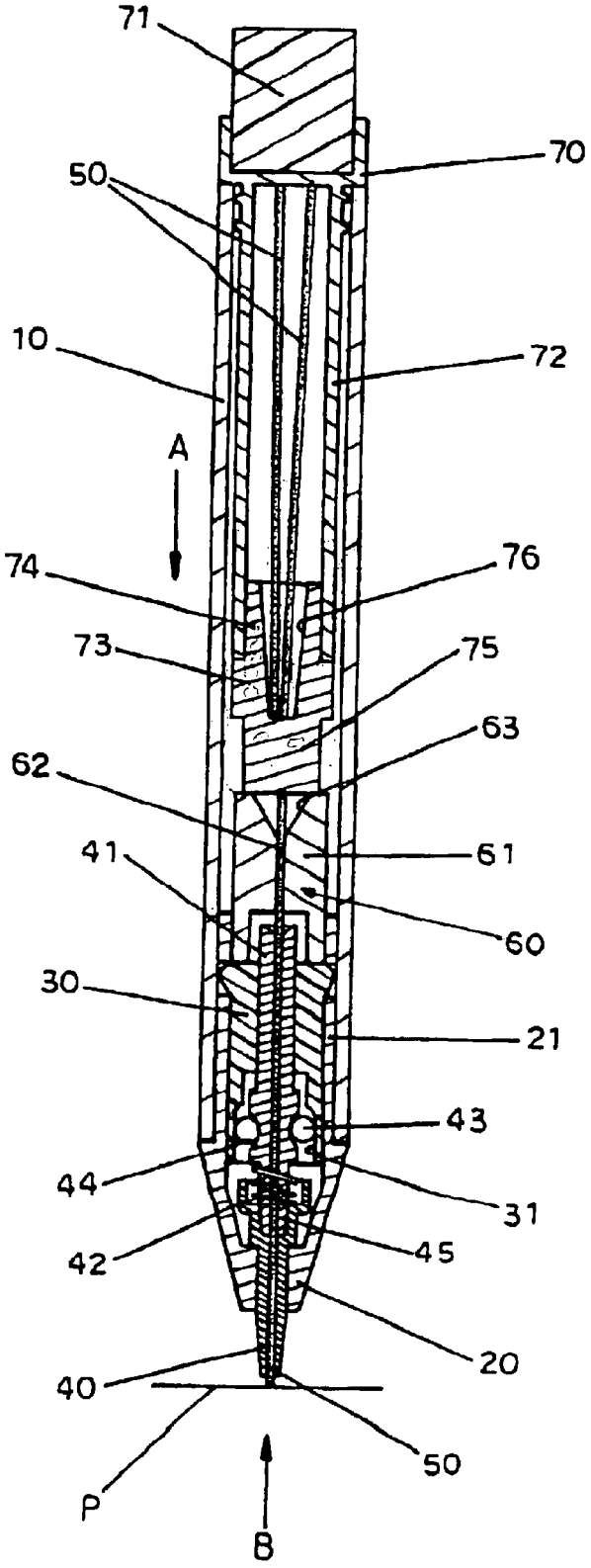
FIG. 4 is a plan cross-sectional view of the automatic pencil assembly as shown in FIG. 1.

The push member 73 is mounted on an end of the extension 72 of the cap 70 to seal the extension 72 of the cap 70 and has a first end formed with a first plug 74 that is insertable into the extension 72 of the cap 70 and a second end formed with a second plug 75 that is insertable into the extension 72 of the cap 70. The first plug 74 of the push member 73 has an outer diameter equal to an inner diameter of the extension 72 of the cap 70 and is formed with a tapered hole 76. The second plug 75 of the push member 73 has an outer diameter equal to the inner diameter of the extension 72 of the cap 70. As shown in FIG. 4, the extension 72 of the cap 70 is used to store a plurality of spare leads 50 which are partially received in the tapered hole 76 of the first plug 74 of the push member 73.

As shown in FIG. 4, the first plug 74 of the push member 73 is inserted into the extension 72 of the cap 70, and the second plug 75 of the push member 73 is protruded outward from the extension 72 of the cap 70.

Figure 5:
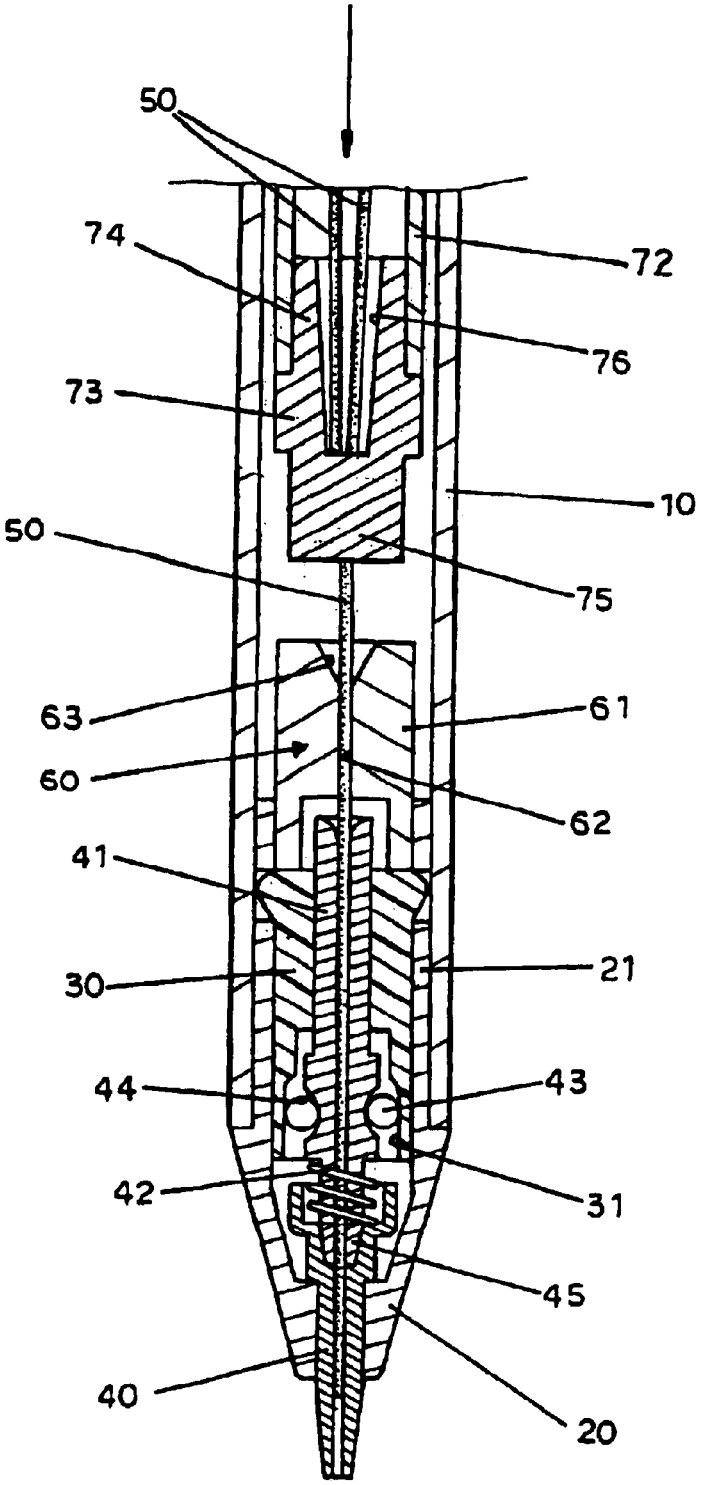
FIG. 5 is a schematic operational view of the automatic pencil assembly as shown in FIG. 4.

When in use, referring to FIGS. 1–5, the cap 70 is removed from the barrel 10, so that the lead 50 is guided through the guide portion 63 of the guide pipe 60 into the guide hole 62 of the guide pipe 60. Then, the lead 50 is extended through the guide hole 62 of the guide pipe 60 and is slid into the clamping members 41. Then, the cap 70 is mounted on the second end of the barrel 10, with the second plug 75 of the push member 73 pressing the upper end of the lead 50 to overcome the holding force of the clamping members 41, so that the lead 50 is in turn extended through the clamping members 41, the retaining race 45 and the slide 40 as shown in FIG. 5, and is then protruded outward from the slide 40 for use as shown in FIG. 4.

Figure 6:
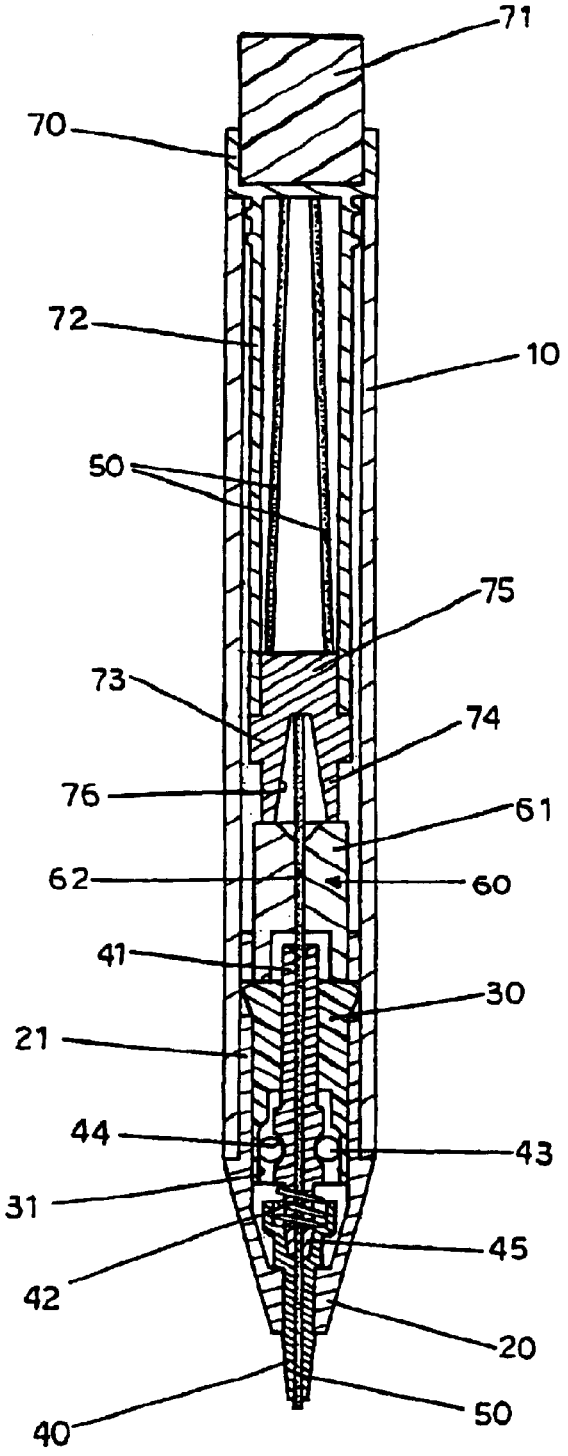
FIG. 6 is another plan cross-sectional view of the automatic pencil assembly as shown in FIG. 1.

As shown in FIG. 6, the second plug 75 of the push member 73 is inserted into the extension 72 of the cap 70, and the first plug 74 of the push member 73 is protruded outward from the extension 72 of the cap 70, with the upper end of the lead 50 being received in the tapered hole 76 of the first plug 74 of the push member 73, so that the automatic pencil is available for leads 50 of different length.

In operation, referring to FIG. 4, when a user exerts a downward force "A" on the cap 70 to press the lead 50 downward by the second plug 75 of the push member 73, the clamping members 41 are moved downward through a small distance by the friction between the clamping members 41 and the lead 50, so that the balls 43 are moved downward by the clamping members 41 to slide into a wider portion the tapered face 31 of the urging member 30 to release the clamping members 41 from the balls 43, such that the clamping members 41 are slightly expanded outward by their elasticity.

Thus, the holding force of the clamping members 41 applied on the lead 50 is released, so that the lead 50 is in turn extended through the clamping members 41, the retaining race 45 and the slide 40 as shown in FIG. 5, and is then protruded outward from the slide 40 for use as shown in FIG. 4. At this time, the friction between the retaining race 45 and the lead 50 overcomes the gravity of the lead 50, so that the lead 50 is positioned in place without further movement.

As shown in FIG. 4, when the lead 50 is rested on a paper "P", the paper "P" applies a reaction force "B" on the lead 50 to move the lead 50 upward, so that the clamping members 41 are moved upward through a small distance by the friction between the clamping members 41 and the lead 50.

In such a manner, the balls 43 are moved upward by the clamping members 41 to slide into a narrower portion the tapered face 31 of the urging member 30 to press the clamping members 41 inward, such that the clamping members 41 are contracted inward by the balls 43 to clamp the lead 50, thereby stopping upward movement of the lead 50. At this time, the balls 43 have a much shorter travel, so that the clamping members 41 and the lead 50 are moved upward through a very small distance, about 0.01 mm, so that the moving distance of the clamping members 41 and the lead 50 can be neglected without affecting the user's writing action.

Accordingly, the tapered face 31 of the urging member 30, the clamping members 41 and the balls 43 form a oneway clamping mechanism, so that the lead 50 can be moved downward and cannot be moved upward. In addition, the slide 40 forms a sliding mechanism, so that when the slide 40 is subjected to the reaction force "B" of the paper "P", the slide 40 is moved through a small distance to pull the lead 50 outward through a small length.

Figure 7:
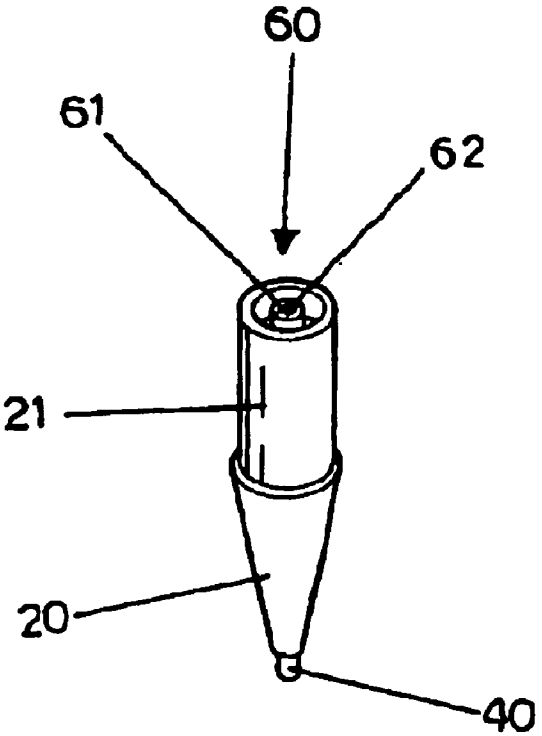
FIG. 7 is a partially perspective view of an automatic pencil assembly in accordance with another embodiment of the present invention.
Figure 8:
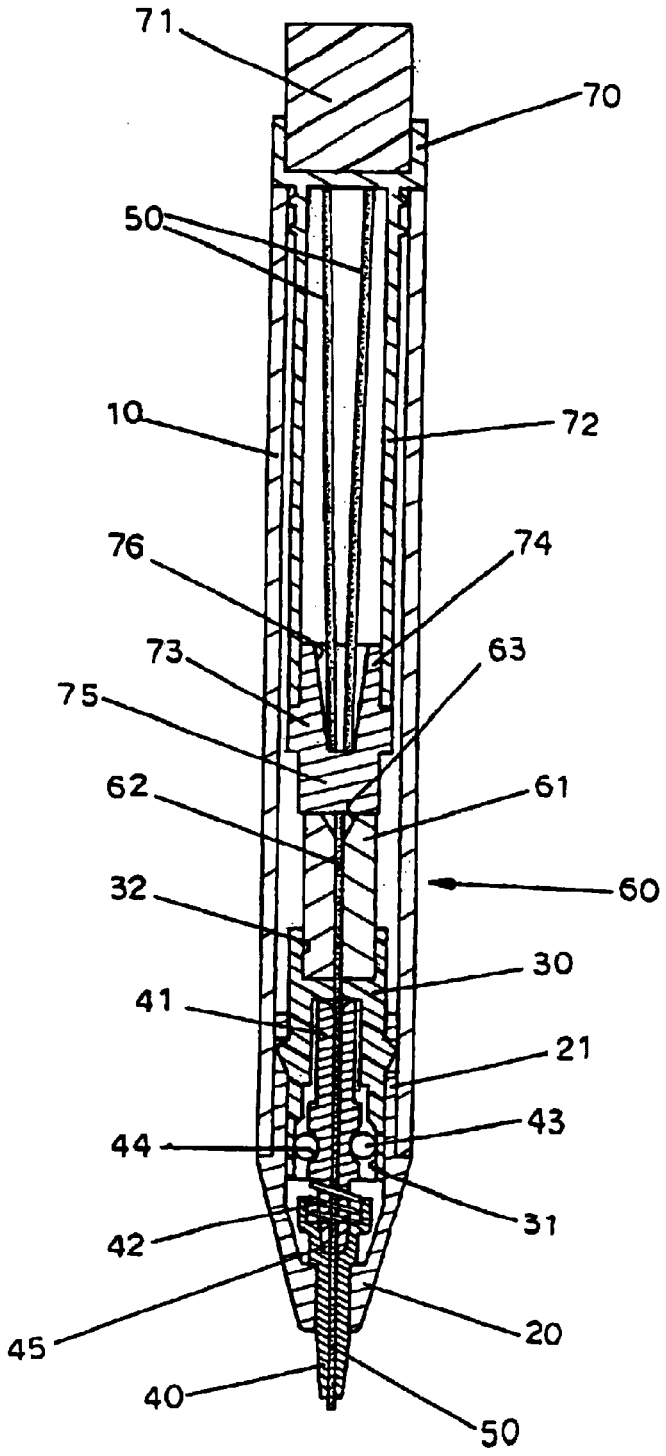
FIG. 8 is a plan cross-sectional view of the automatic pencil assembly as shown in FIG. 7.
Figure 9:
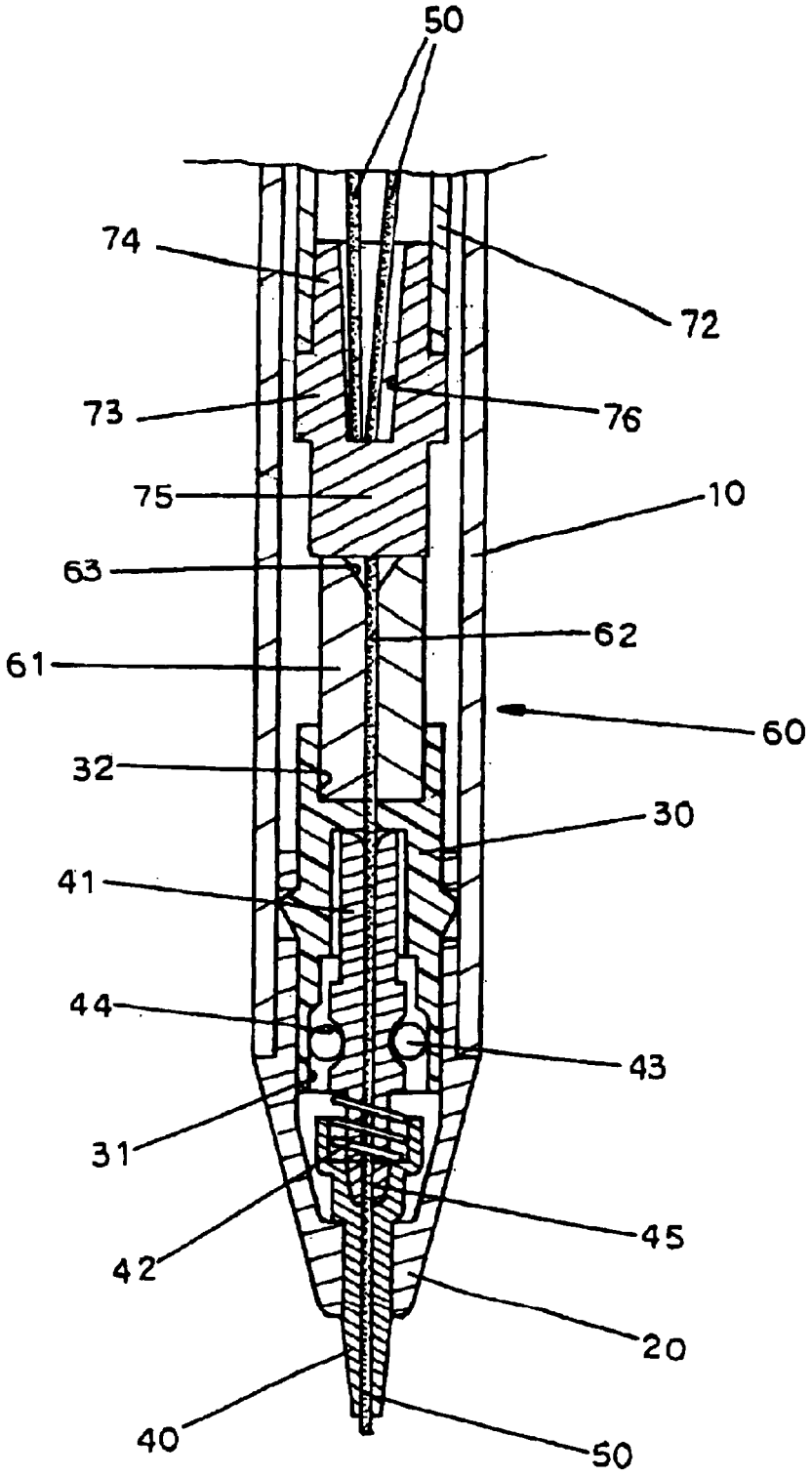
FIG. 9 is a partially enlarged view of the automatic pencil assembly as shown in FIG. 8.

Referring to FIGS. 7–9, in accordance with another embodiment of the present invention, the urging member 30 is formed with a receiving recess 32 for receiving the guide pipe 60.

Figure 10:
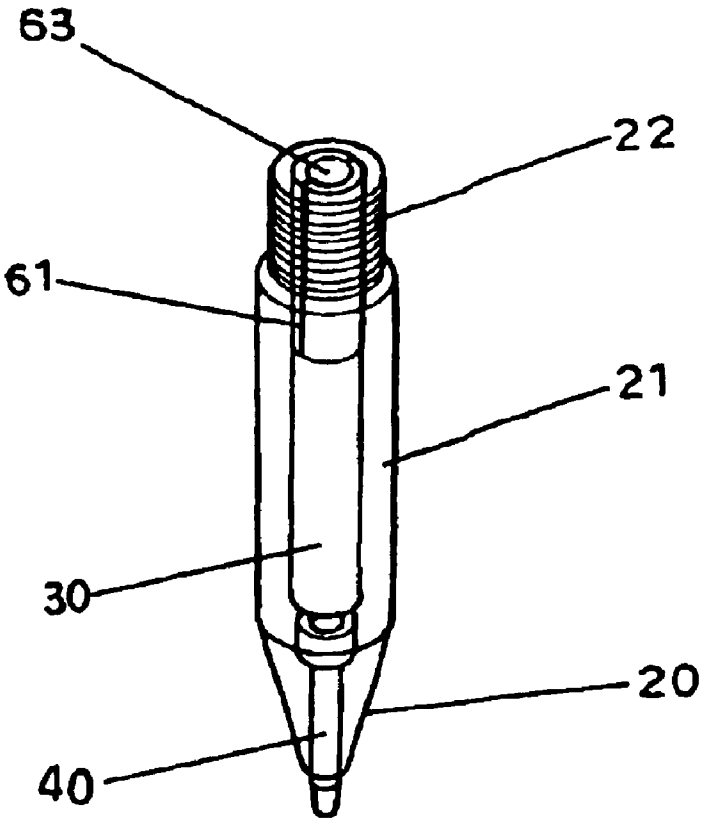
FIG. 10 is a partially perspective view of an automatic pencil assembly in accordance with another embodiment of the present invention.
Figure 11:
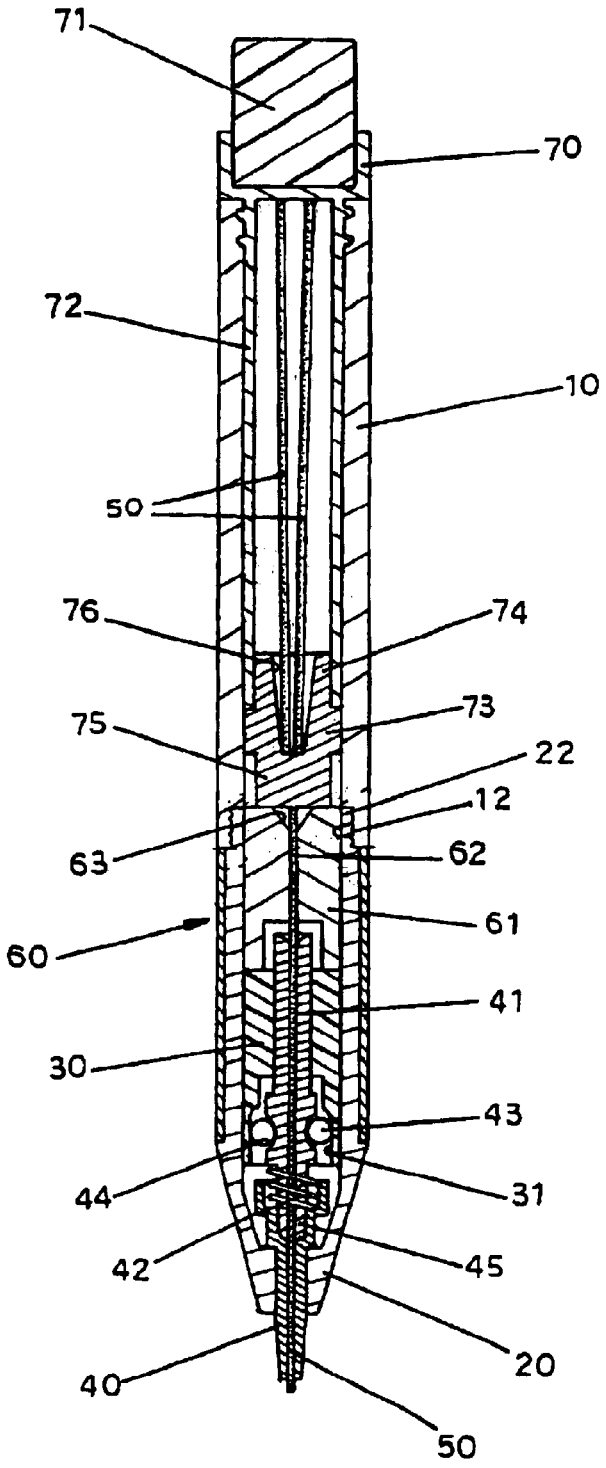
FIG. 11 is a plan cross-sectional view of the automatic pencil assembly as shown in FIG. 10.
Figure 12:
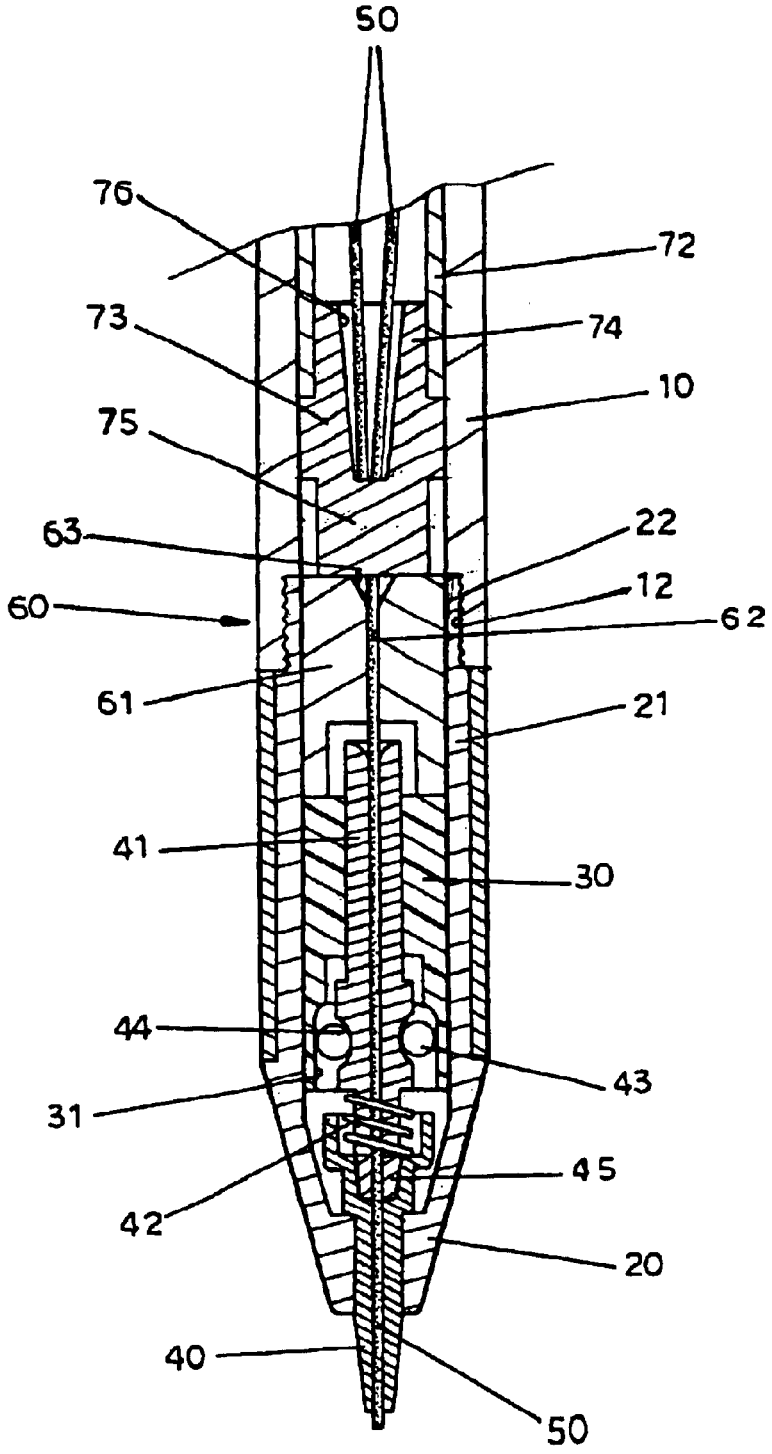
FIG. 12 is a partially enlarged view of the automatic pencil assembly as shown in FIG. 11.

Referring to FIGS. 10–12, in accordance with another embodiment of the present invention, the first end of the barrel 10 is formed with an inner thread 12, and the sleeve 21 of the point 20 is formed with an outer thread 22 screwed into the inner thread 12 of the barrel 10, so that the point 20 is combined with the barrel 10 easily and conveniently.

Figure 13:
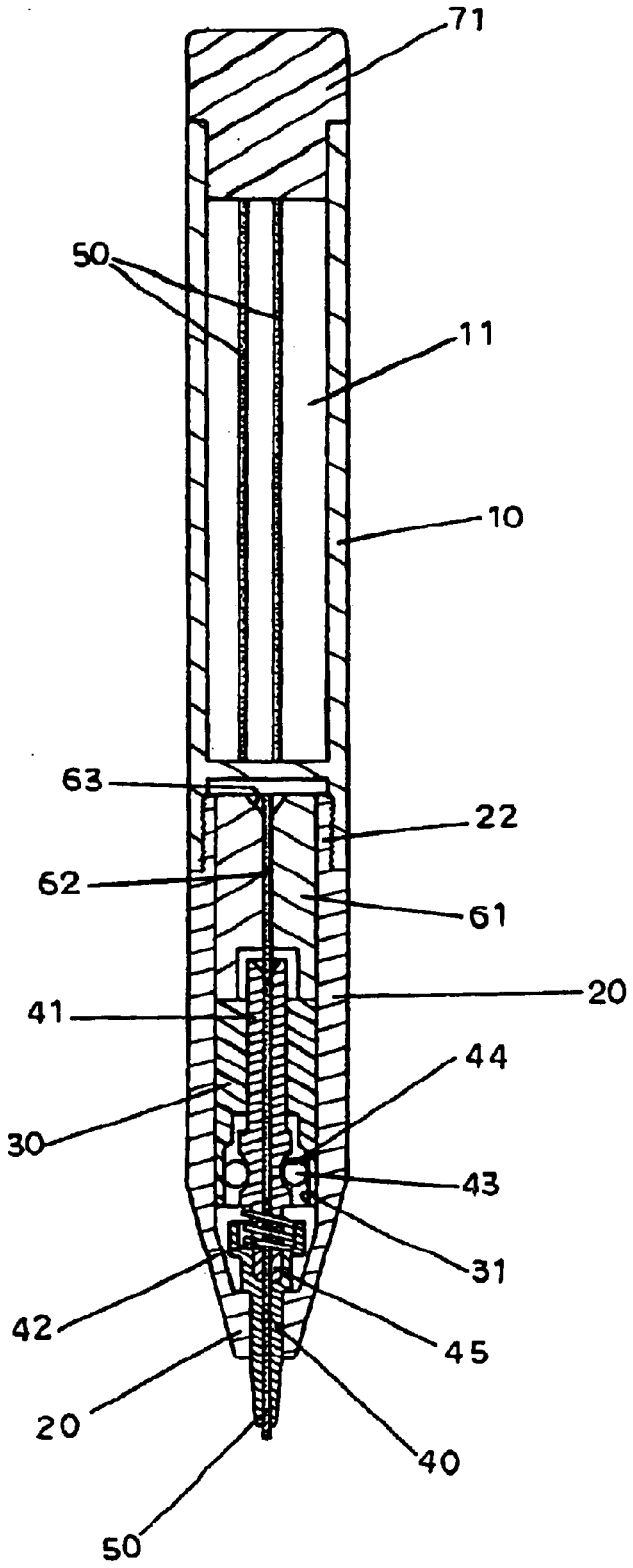
FIG. 13 is a plan cross-sectional view of an automatic pencil assembly in accordance with another embodiment of the present invention.

Referring to FIG. 13, in accordance with another embodiment of the present invention, the barrel 10 has an inside formed with a receiving chamber 11 for receiving the leads 50. The receiving chamber 11 of the barrel 10 has a closed first end and an opened second end, and the eraser 71 is directly mounted on the opened second end of the receiving chamber 11 of the barrel 10.

Figure 14:
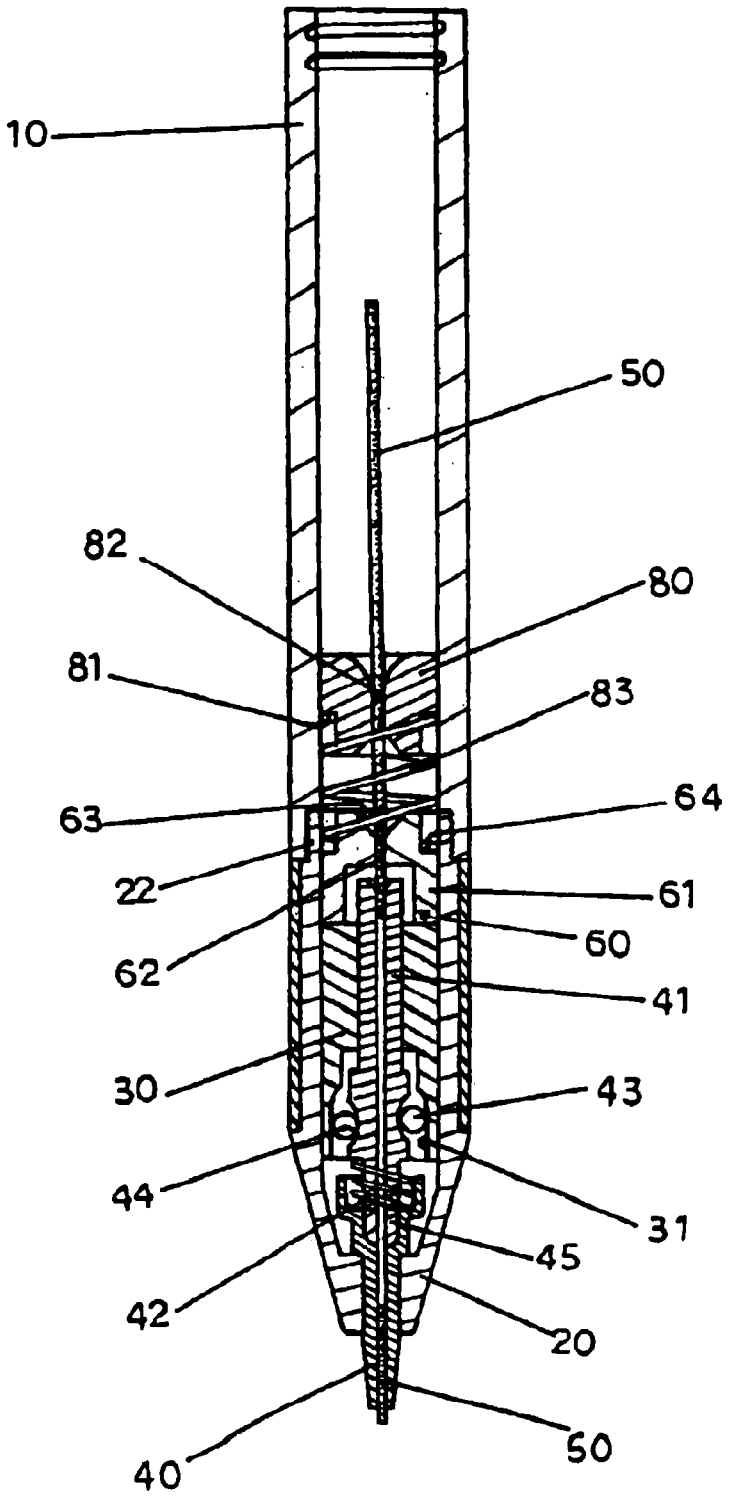
FIG. 14 is a plan cross-sectional view of an automatic pencil assembly in accordance with another embodiment of the present invention.
Figure 15:
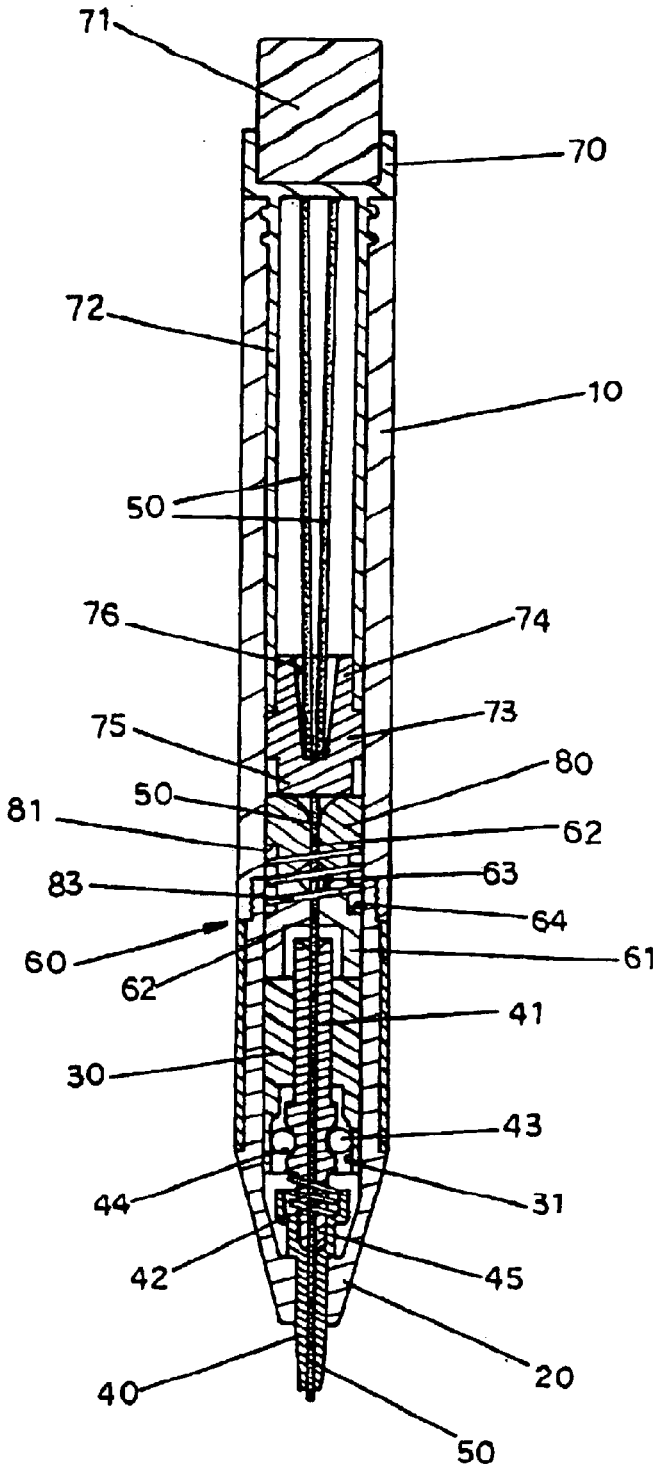
FIG. 15 is a schematic operational view of the automatic pencil assembly as shown in FIG. 14.
Figure 16:
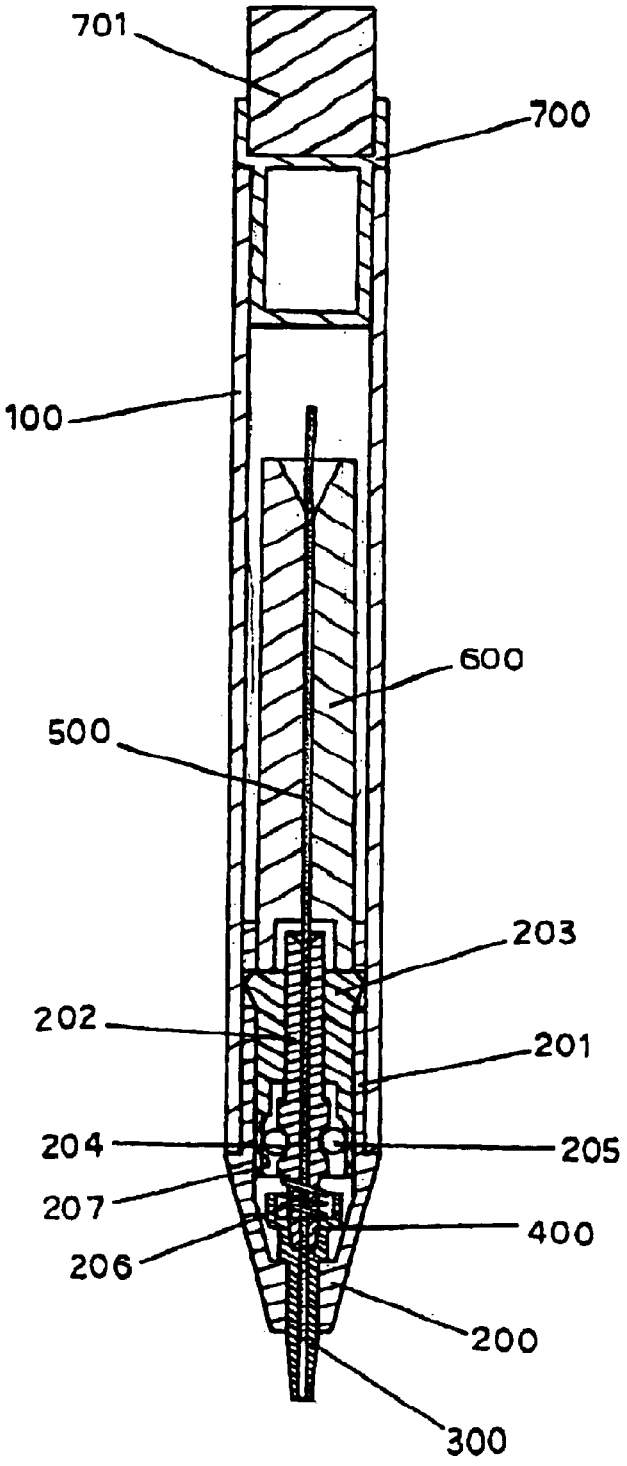
F I G. 16 PRIOR ART
FIG. 16 is a plan cross-sectional view of a conventional automatic pencil in accordance with the prior art.

Referring to FIGS. 14 and 15, in accordance with another embodiment of the present invention, the automatic pencil assembly further comprises a movable pipe 80 movably mounted in the barrel 10 and formed with a through hole 82, and a spring 83 mounted between the movable pipe 80 and the guide pipe 60. Preferably, the guide pipe 60 has an outer wall formed with an annular mounting portion 64 for mounting a first end of the spring 83, and the movable pipe 80 has an outer wall formed with an annular mounting portion 64 for mounting a second end of the spring 83.

When the lead 50 has a shorter length as shown in FIG. 14, a new lead 50 is inserted into the through hole 82 of the movable pipe 80. Then, the cap 70 is mounted on the second end of the barrel 10 as shown in FIG. 15, with the second plug 75 of the push member 73 pressing the upper end of the new lead 50, so that the new lead 50 is inserted into the guide hole 62 of the guide pipe 60. At the same time, the movable pipe 80 is pressed downward to overcome the elastic force of the spring 83, so that the new lead 50 is moved downward to abut the smaller lead 50 as shown in FIG. 15.

Accordingly, the rectangular guide hole 62 of the guide pipe 60 only allows passage of one lead 50, thereby preventing the leads 50 from jamming. In addition, the guide pipe 60 is formed be combining two semi-circular tubular 61 together, so that the guide pipe 60 is made easily and rapidly, thereby decreasing costs of fabrication. Further, the rectangular guide hole 62 of the guide pipe 60 facilitates passage of the lead 50, so that the lead 50 is moved in the rectangular guide hole 62 of the guide pipe 60 smoothly and conveniently. Further, the lead 50 is pressed downward by the first plug 74 or second plug 75 of the push member 73 to overcome the holding force of the clamping members 41, so that the lead 50 is inserted into and protruded outward from the slide 40 easily and conveniently. Further, the extension 72 of the cap 70 is used to store a plurality of spare leads 50, thereby facilitating the user carrying the leads 50. Further, the first end of the barrel 10 is formed with an inner thread 12, and the sleeve 21 of the point 20 is formed with an outer thread 22 screwed into the inner thread 12 of the barrel 10, so that the point 20 is combined with the barrel 10 easily and conveniently.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. An automatic pencil assembly, comprising:

a barrel, a point, an urging member, two clamping members, a slide, a guide pipe, a lead, a cap, and a push member, wherein:

the barrel has a first end and a second end;

the point is mounted on the first end of the barrel and has a first end formed with a sleeve inserted into the first end of the barrel;

the urging member is mounted in the first end of the barrel and is secured in the sleeve of the point;

each of the two clamping members is slidably mounted in the urging member;

the slide is slidably mounted in the point and has a first end provided with a retaining race and a second end protruded outward from a second end of the point;

the guide pipe is mounted in the barrel and is rested on an end of the urging member;

the lead is in turn extended through the guide pipe, the clamping members, the retaining race and the slide and has a first end protruded outward from the guide pipe and a second end protruded outward from the slide;

the cap is mounted on the second end of the barrel and has an end formed with a cylindrical extension extended into the barrel; and the push member is mounted on an end of the extension of the cap to seal the extension of the cap and is rested on the first end of the lead, the push member has a first end formed with a first plug that is insertable into the extension of the cap and a second end formed with a second plug that is insertable into the extension of the cap.

2. The automatic pencil assembly in accordance with claim 1, wherein the first plug of the push member is formed with a tapered hole.

3. The automatic pencil assembly in accordance with claim 2, wherein the extension of the cap receives therein a plurality of spare leads which are partially received in the tapered hole of the first plug of the push member.

4. The automatic pencil assembly in accordance with claim 1, wherein the first plug of the push member has an outer diameter equal to an inner diameter of the extension of the cap.

5. The automatic pencil assembly in accordance with claim 1, wherein the second plug of the push member has an outer diameter equal to an inner diameter of the extension of the cap.

6. The automatic pencil assembly in accordance with claim 1, wherein the first plug of the push member is inserted into the extension of the cap, and the second plug of the push member is protruded outward from the extension of the cap and is rested on the first end of the lead.

7. The automatic pencil assembly in accordance with claim 1, wherein the second plug of the push member is inserted into the extension of the cap, and the first plug of the push member is protruded outward from the extension of the cap and is rested on the first end of the lead.

8. The automatic pencil assembly in accordance with claim 1, wherein the urging member is formed with a receiving recess for receiving the guide pipe.

9. The automatic pencil assembly in accordance with claim 1, wherein the first end of the barrel is formed with an inner thread, and the sleeve of the point is formed with an outer thread screwed into the inner thread of the barrel.

10. The automatic pencil assembly in accordance with claim 1, wherein the barrel has an inside formed with a receiving chamber for receiving the lead.

11. The automatic pencil assembly in accordance with claim 1, wherein the receiving chamber of the barrel has a closed first end and an opened second end, and the automatic pencil assembly further comprises an eraser mounted on the opened second end of the receiving chamber of the barrel.

12. The automatic pencil assembly in accordance with claim 1, further comprising a movable pipe movably mounted in the barrel and formed with a through hole for passage of the lead, and a spring mounted between the movable pipe and the guide pipe.

13. The automatic pencil assembly in accordance with claim 12, wherein the guide pipe has an outer wall formed with an annular mounting portion for mounting a first end of the spring, and the movable pipe has an outer wall formed with an annular mounting portion for mounting a second end of the spring.

14. The automatic pencil assembly in accordance with claim 1, wherein the urging member has an inner wall formed with a tapered face, and each of the two clamping members has an outer wall formed with a cavity for receiving a plurality of balls which are urged on the tapered face, so that the balls are moved by the clamping members between a first position where the balls are rested on a narrower portion the tapered face of the urging member to press the clamping members inward, and a second position where the balls are rested on a wider portion the tapered face of the urging member to release the clamping members from the balls.

15. The automatic pencil assembly in accordance with claim 1, further comprising a spring mounted in the first end of the slide and urged between the slide and the clamping members.

16. The automatic pencil assembly in accordance with claim 1, wherein the guide pipe has an inside formed with a rectangular guide hole communicating with the two clamping members, and the lead is extended through the guide hole of the guide pipe.

17. The automatic pencil assembly in accordance with claim 1, wherein the guide pipe consists of two semi-circular tubular combined with each other.

* * * * *